US006368235B1

(12) United States Patent
Sutherland

(10) Patent No.: US 6,368,235 B1
(45) **Date of Patent: *Apr. 9, 2002**

(54) GOLF BALL WITH PERFORATED BARRIER SHELL

(76) Inventor: Richmond M. Sutherland, 466 Saunders Ave., Akron, OH (US) 44319

( * ) Notice: Subject to any disclaimer, the term of this patent is extended or adjusted under 35 U.S.C. 154(b) by 0 days.

This patent is subject to a terminal disclaimer.

(21) Appl. No.: 09/604,883

(22) Filed: Jun. 26, 2000

Related U.S. Application Data

(63) Continuation of application No. 09/309,967, filed on May 11, 1999, now Pat. No. 6,102,815.

(51) Int. Cl.[7] ..... A63B 37/06
(52) U.S. Cl. ..... 473/372; 473/371
(58) Field of Search ..... 473/351, 370, 473/371, 372

(56) References Cited

U.S. PATENT DOCUMENTS

| | | | | | |
|---|---|---|---|---|---|
| 646,350 | A | * | 3/1900 | Breinl | 473/602 |
| 701,741 | A | * | 6/1902 | Kempshall | 473/370 |
| 705,249 | A | * | 7/1902 | Kempshall | 473/370 |
| 705,359 | A | * | 7/1902 | Kempshall | 473/370 |
| 1,182,604 | A | * | 5/1916 | Wadsworth | 473/372 |
| 1,470,302 | A | * | 10/1923 | Thomas | 473/359 |
| 1,524,171 | A | * | 1/1925 | Chatfield | 473/373 |
| 1,568,514 | A | * | 1/1926 | Lewis | 473/358 X |
| 2,264,604 | A | * | 12/1941 | Young | 473/361 |
| 2,786,684 | A | * | 3/1957 | Muccino | 473/359 |
| RE25,427 | E | * | 7/1963 | Harkins | 473/359 |
| 4,836,552 | A | * | 6/1989 | Puckett et al. | 473/372 |
| 4,839,116 | A | * | 6/1989 | Puckett et al. | 264/45.3 |
| 4,858,923 | A | * | 8/1989 | Gobush et al. | 473/365 |
| 5,018,740 | A | * | 5/1991 | Sullivan | 473/372 |
| 5,104,126 | A | * | 4/1992 | Gentiluomo | 473/374 |
| 5,273,286 | A | * | 12/1993 | Sun | 473/373 |
| 5,387,637 | A | * | 2/1995 | Sullivan | 524/493 |
| 5,688,191 | A | * | 11/1997 | Cavallaro et al. | 473/373 |
| 5,688,192 | A | * | 11/1997 | Aoyama | 473/374 |
| 5,688,595 | A | * | 11/1997 | Yamagishi et al. | 428/375 |
| 5,713,801 | A | * | 2/1998 | Aoyama | 473/354 |
| 6,102,815 | A | * | 8/2000 | Sutherland | 473/372 |

* cited by examiner

*Primary Examiner*—John A. Ricci
(74) *Attorney, Agent, or Firm*—Pittas & Koenig,; Philip G. Koenig

(57) ABSTRACT

Disclosed is a golf ball designed for longer travel relative the compression of the ball. The golf ball includes: (1) a flexible inner core, preferably comprised of crosslinked synthetic rubber, (2) a perforated barrier shell positioned outside of, and surrounding, the inner core to lessen deformation of the ball when the ball is struck by a golf club, (3) a flexible outer core, preferably comprised of crosslinked, synthetic rubber or windings, positioned outside of and surrounding the perforated barrier shell, and (4) an outer cover, preferably comprised of ionomeric resin material, positioned outside of and surrounding the outer core. The perforated barrier shell reduces deformation of the golf ball upon impact by a golf club and is preferably formed as a sphere centered in the golf ball, preferably having a diameter equal to one-half the diameter of the golf ball.

35 Claims, 12 Drawing Sheets

GOLF BALL WITH PERFORATED BARRIER SHELL

This is a continuation application of U.S. Patent application Ser. No. 09/309,967 filed on May 11, 1999 now U.S. Pat. No. 6,102,815.

FIELD OF THE INVENTION

The present invention relates generally to golf balls and more particularly to an improved distance golf ball having a perforated inner shell positioned in the core in such a manner that it reduces the overall deformation of the ball when it is impacted by a golf club thereby increasing the travel of the ball.

BACKGROUND

Conventional golf balls can be divided into two general types: two-piece balls and three-piece balls (also known as wound balls).

Two-piece balls are made with a one-piece compressible, resilient core encased by a cover material. The core is usually made of a compression- or injection-molded cross-linked rubber such as a chemically cross-linked polybutadiene and has about the same size as a wound core, i.e., approximately 1.45 to 1.61 inches in diameter. The cover is generally injection molded or compression molded about the core and may be comprised of a urethane material, a synthetic balata rubber material, or a blend of ionomer resins, such as the various grades of ionomer resins produced by DuPont which are trademarked SURLYN, or the various types of ionomer resins produced by EXXON CHEMICAL which are trademarked IOTEK.

Three-piece balls, also known as wound balls, typically have either a solid rubber or liquid-filled bladder center core which may vary in diameter from ⅜ of an inch to 1 1/16 inches. Such center cores are then tightly wound with elastic thread to form a complete core which may have a diameter of approximately 1.45 to 1.61 inches. The complete wound core is then covered with a urethane, balata, ionomer, or similar material. The cover material is usually either compression molded or injection molded around the wound core to form a final ball that typically measures 1.68 inches in diameter. As a result of their more complex structure, wound balls generally require a longer time to manufacture and are more expensive to produce than one- or two-piece balls.

Multi-piece golf balls are also known and come in various forms. For example, a golf ball has been disclosed that includes at least five parts including a three-part solid core having a center section surrounded by two outer layers molded one about the other, each made of a elastomeric material to form the entire center core, and two cover layers made up of differing blends of ionomer type resins wherein the inner cover layer may be harder or softer than the outer dimpled cover layer. Purportedly, this ball travels a satisfactory distance and may have its coefficient of restitution, feel, and spin rate adjusted by changing the chemical composition of the various polymer blends that make up its multi-piece core and covers.

Golf balls are also disclosed that contain either one-piece solid cores or two-piece wound cores with two or more layers of cover material. The harder inner cover layers of these balls purportedly increase the coefficient of restitution of these balls and promote increased travel, and the softer dimpled outer covers purportedly increase the softer feel and the spin rates of these balls.

Other golf balls are also disclosed that contain solid spherical metal cores, metal cores of various shapes and diameters, and cores containing steel balls; the purpose usually being to increase the ball's flight (also referred to as travel or distance) and to create more accurate flight. Such prior art golf balls, however, are impractical because they are too expensive to manufacture, and have undesirable characteristics such as heavy centers and lighter exteriors which increase the spin rates of these balls to undesirable levels, or because their design would not be sanctioned by the United Sates Golf Association for use in tournament play.

A ball incorporating a resilient, springy, perforated metal sphere near its outer circumference to maintain the shape and integrity of a cover made of unstable gutta-percha and prevent the gutta-percha from becoming misshapen when struck with a golf club is also known, and is described in U.S. Pat. No. 705,249. Gutta-percha, a tree sap in its natural gum form, was utilized as a golf ball cover material in the late 1800s and early 1900s. By reason of being mounted just beneath the surface of the gutta-percha cover whereby portions of the gutta-percha were forced into the perforations, the flexible, springy, perforated metal shell of this golf ball served to reinforce the unstable gutta-percha cover and help it from becoming misshapen when struck with a golf club, rendering the ball dead under a light blow. Col. 1, 11. 49–51.

It should be noted that all known golf balls may be made larger than (but not smaller than) the accepted 1.68 inch diameter size and still be approved for tournament play by the United States Golf Association.

There remains a need for a multi-piece, three piece, two-piece, or one-piece ball that has longer travel relative to its compression.

SUMMARY OF THE INVENTION

The present invention improves upon the prior art by providing a golf ball including: (1) an inner core comprised of a compressible or flexible material, such as cross-linked rubber or a liquid-filled bladder, (2) a perforated barrier shell positioned around the inner center core, (3) an outer core comprised of either (a) a compressible elastomeric material, such as cross-linked rubber or plastic of the type that forms the inner core, or a synthetic polymer gel-type material (b) layers of such material(s), or (c) layers of tightly wound elastic thread, and (4) a dimpled outer cover, which may be comprised of one or more layers, and made of thermoplastic elastomers, urethane elastomers, either natural or synthetic balata rubber, various grades, types, and blends of ionomer resins such as SURLYN manufactured by DuPont or IOTEK manufactured by Exxon Chemical, or combinations thereof.

Preferably having a common center with the inner core of the golf ball, the perforated barrier shell is preferably spherical and may have a diameter ranging from approximately 0.35 inches to approximately 1.26 inches depending upon the desired coefficient of restitution of the golf ball and its desired degree of hardness (feel) relative to the composition and type of the golf ball's outer core.

The theory of why it is believed a ball including the perforated barrier shell of the invention has superior characteristics shall now be explained. It will be understood, however, that the invention is not limited by any particular theory and that the scope of protection afforded the invention is set forth in the claims. When the golf ball is struck by a golf club, the ball is compressed or forced into an out-of-round shape with its area of contact actually flattening against the face of the club. The perforated barrier shell is designed to allow for compression and to promote the increased rebound of the ball, which leads to longer flight. As is generally represented in FIG. 5*a*, the perforated barrier shell reduces the overall amount the ball is pushed into an out-of-round shape by arresting and confining a portion of the force created by the golf club to the area of the ball located between the club face and the surface of the barrier shell closest to the club's point of impact, thereby preventing a portion of this force from passing through the barrier shell and contributing to the overall deformation of the ball's entire mass. When allowed to flow unrestricted throughout the entire ball, much of this force is dissipated in the non-productive generation of heat energy and absorbed in the non-productive distortion of areas of the ball located away from the point of impact. The perforated barrier shell thus reduces the amount of energy normally devoted to the non-productive deformation of the golf ball's entire mass and serves to reflect this energy back against the face of the golf club thereby utilizing the redirected energy to enhance the ball's coefficient of restitution and increase its rebound speed and length of travel. Therefore, use of the present invention permits golfers to obtain longer distance with the same swing speed, or the same distance with lower compression balls utilizing the present invention as with known balls of higher compression ratings.

In addition to decreasing the overall deformation of the golf ball when it is struck with a golf club, in many embodiments of the invention, the ball's outer and inner core materials come into direct physical contact with each other as they are forced into and through perforations in the barrier shell when the ball is compressed with a golf club. A portion of the energy generated by the golf club impacting the ball is thus transmitted through the openings or perforations in the barrier shell directly from the club's point of impact through the ball's cover and outer core material, into the inner core material, and through it to the opposing portion of the outer core material(s). Thus, as a result of the perforations in the barrier shell, the inner and outer core materials provide a continuous physical medium for the partial transfer of the energy and/or force generated by the club's impact through the center of the ball instead of forcing this energy to completely circumvent the inner core material.

Further, if the barrier shell did not include perforations to permit energy to pass through it, some of the energy/force generated by the ball's compression would not be permitted to pass through the center core material. In that case, more of this energy/force could then be made to travel in one direction around the perimeter of the barrier shell and the energy/force could thus be skewed off center. Since this unbalanced transfer of energy could cause the ball to be compressed to a greater degree in one portion of the ball's impact area and thereby exert uneven rebound pressure back against the face of the club, the ball could be thrust off line at an undesirable angle away from its intended line of flight as it rebounds off the club face. This condition could also cause the ball to assume a severe lateral spin bias resulting in unwanted hooks or slices which would cause the ball to curve left or right of the desired target line. It should be noted that both of these situations would be exacerbated by off-center hits, i.e., impacts by a club not delivered perfectly square, or wherein the club face is not perpendicular to the desired direction of travel when it strikes the ball. Common among golfers of all skill levels, such off-center hits would thus cause an even more unbalanced transfer of energy/force back against the club face if none or little of the energy/force generated by the ball's compression were able to pass through the center of the ball.

DETAILED DESCRIPTION OF A PREFERRED EMBODIMENT

References are made herein to the theory behind the improved functioning of the invention. This theory is believed to be accurate and is meant to better explain the functioning of a golf ball according to the invention. It shall be understood, however, that the invention is not limited to any particular theory but is instead set forth in the structures recited in the claims.

Figure 1:
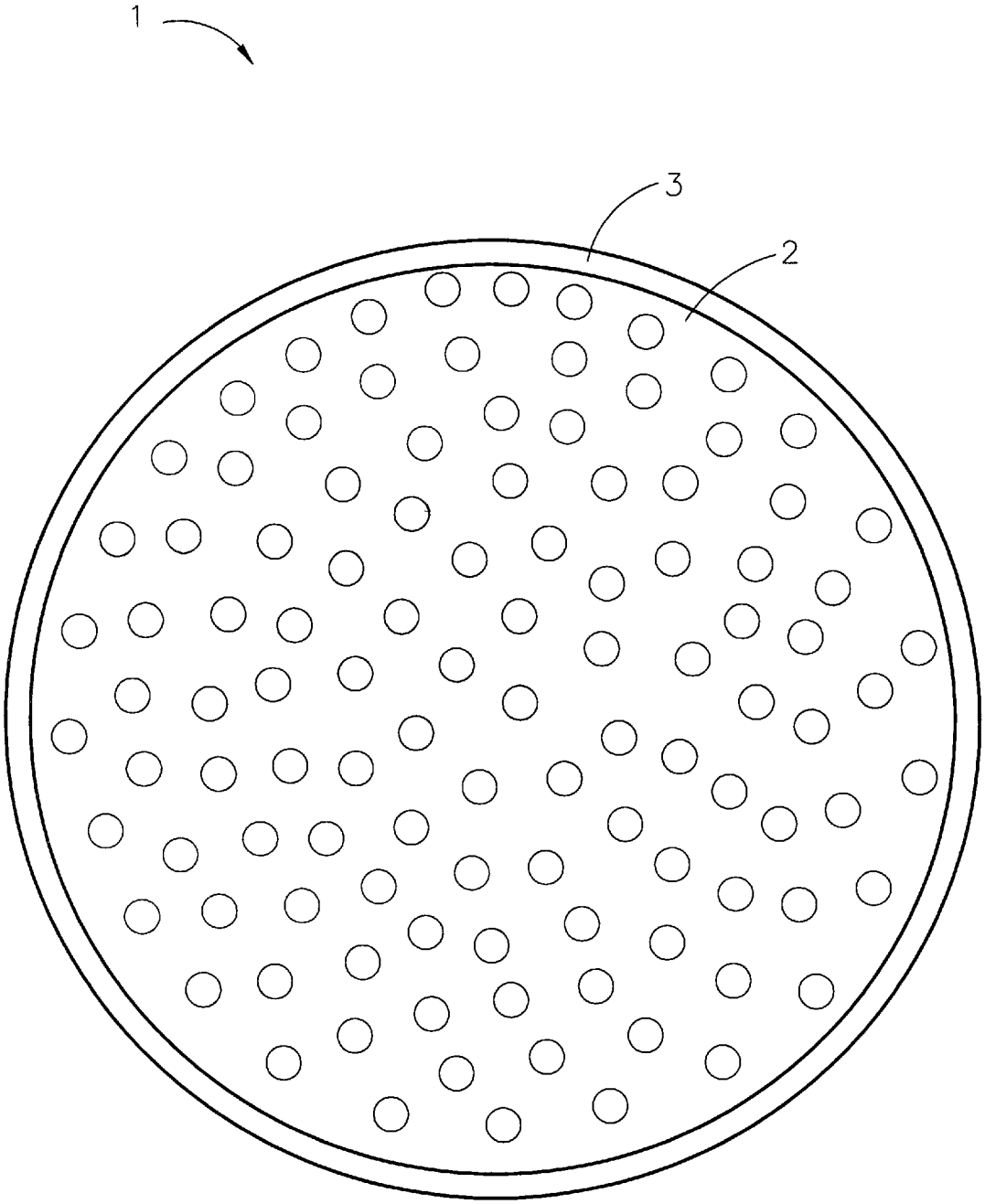
PRIOR ART FIG. 1
FIG. 1 is a cross-sectional view of a prior art two-piece golf ball.
Figure 2:
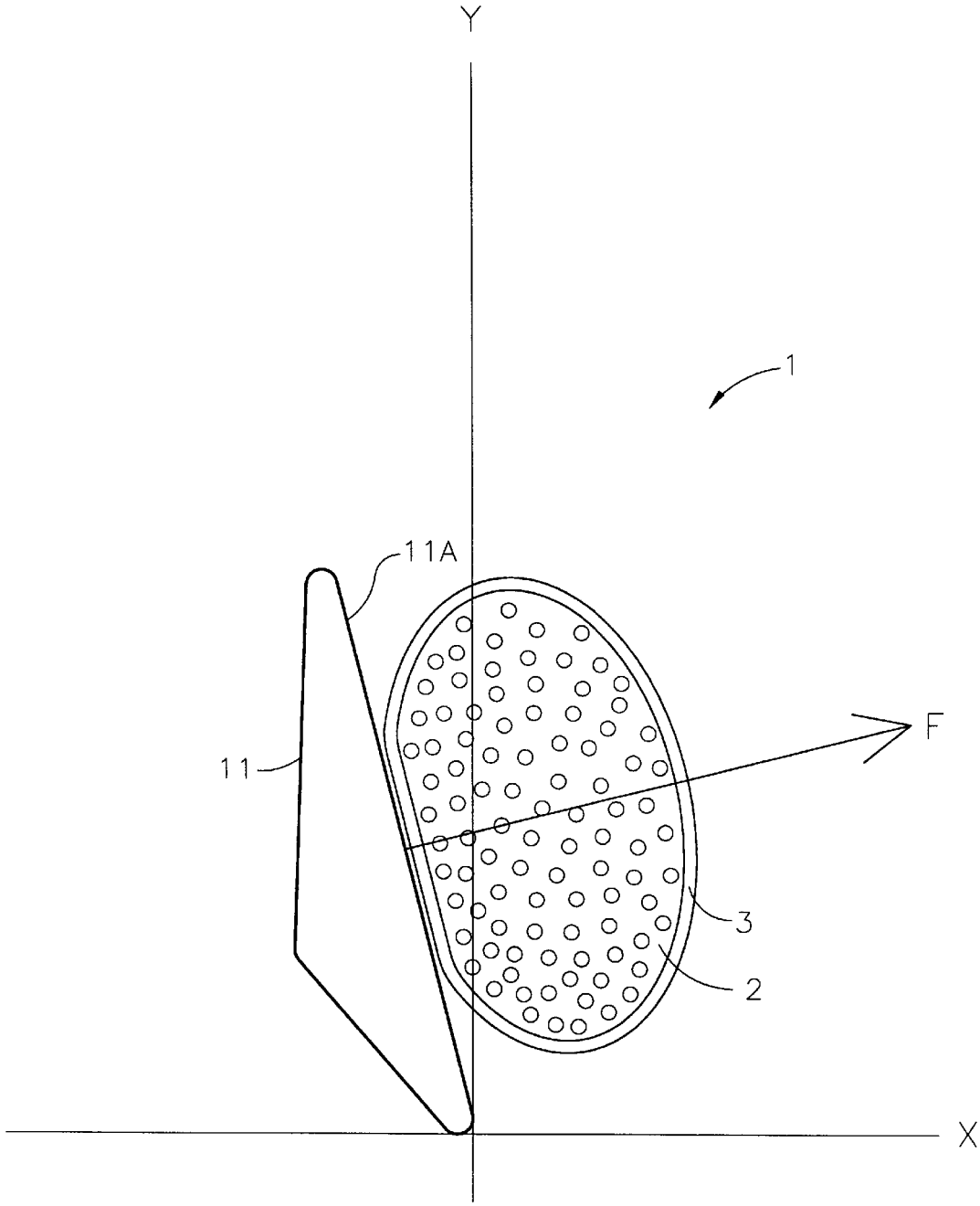
PRIOR ART FIG. 2
FIG. 2 is a cross-sectional view of a prior art two-piece golf ball beings truck by a golf club.
Figure 2A:
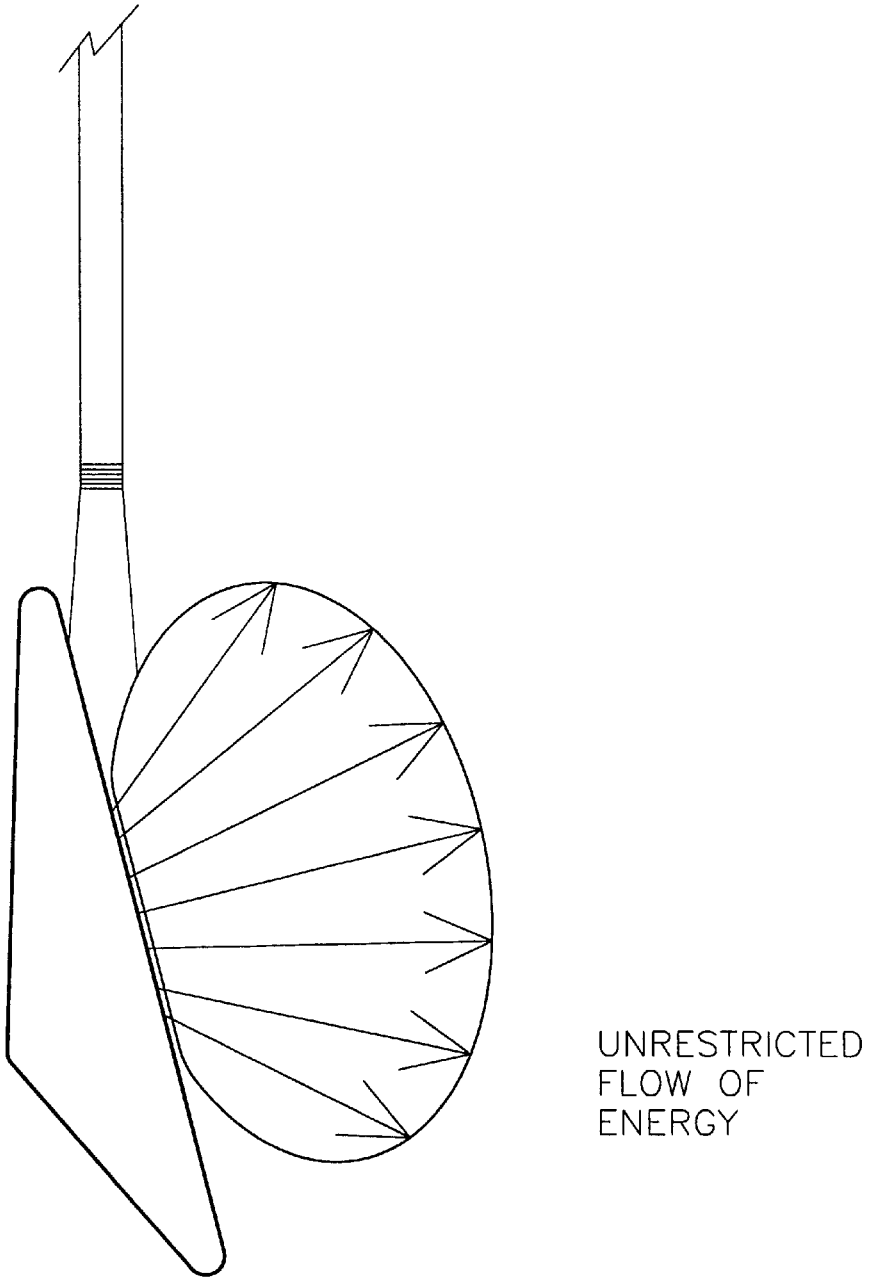
PRIOR ART FIG. 2A
FIG. 2*a* shows the unrestricted flow of force through the golf ball shown in FIGS. 1 and 2 when it is struck by a golf club.

Turning now to the Figures where the purpose is to describe a preferred embodiment of the invention and not to limit the scope thereof, FIG. 1 shows a prior art, two-piece golf ball 1 having an inner core 2, usually made of polybutadiene, and outer cover 3, usually made of a synthetic balata type material or any ionomer resins, such as SURLYN or IOTEK. FIG. 2 shows ball 1 at the point of impact by golf club 11. F is a component of force perpendicular to the face of golf club 11. As is generally represented in FIG. 2, force F deforms golf ball 1 upon the impact of club 11 thereby flattening the portion of ball 1 in contract with face 11A of club 11 and pushing ball 1 into an out-of-round configuration. As ball 1 leaves face 11A of club 11, part of its travel is caused by the rebound of ball 1 off face 11A along vector F as the ball springs back into its normal round configuration.

Some of the force generated by club 11, however, is dissipated in the non-productive generation of heat energy and absorbed in distorting the area of the ball located farthest from the point of impact and thus does little to enhance the speed of the ball's rebound into its normal spherical shape. This force is not transmitted along vector F and does not add to the rebound velocity and subsequent length of travel of the ball. Because this same phenomenon occurs in all known golf balls of two-piece, three-piece, and multi-piece construction, it is important to note that the present invention will enhance the speed of rebound and subsequent length of travel of these types of balls.

Figure 3:
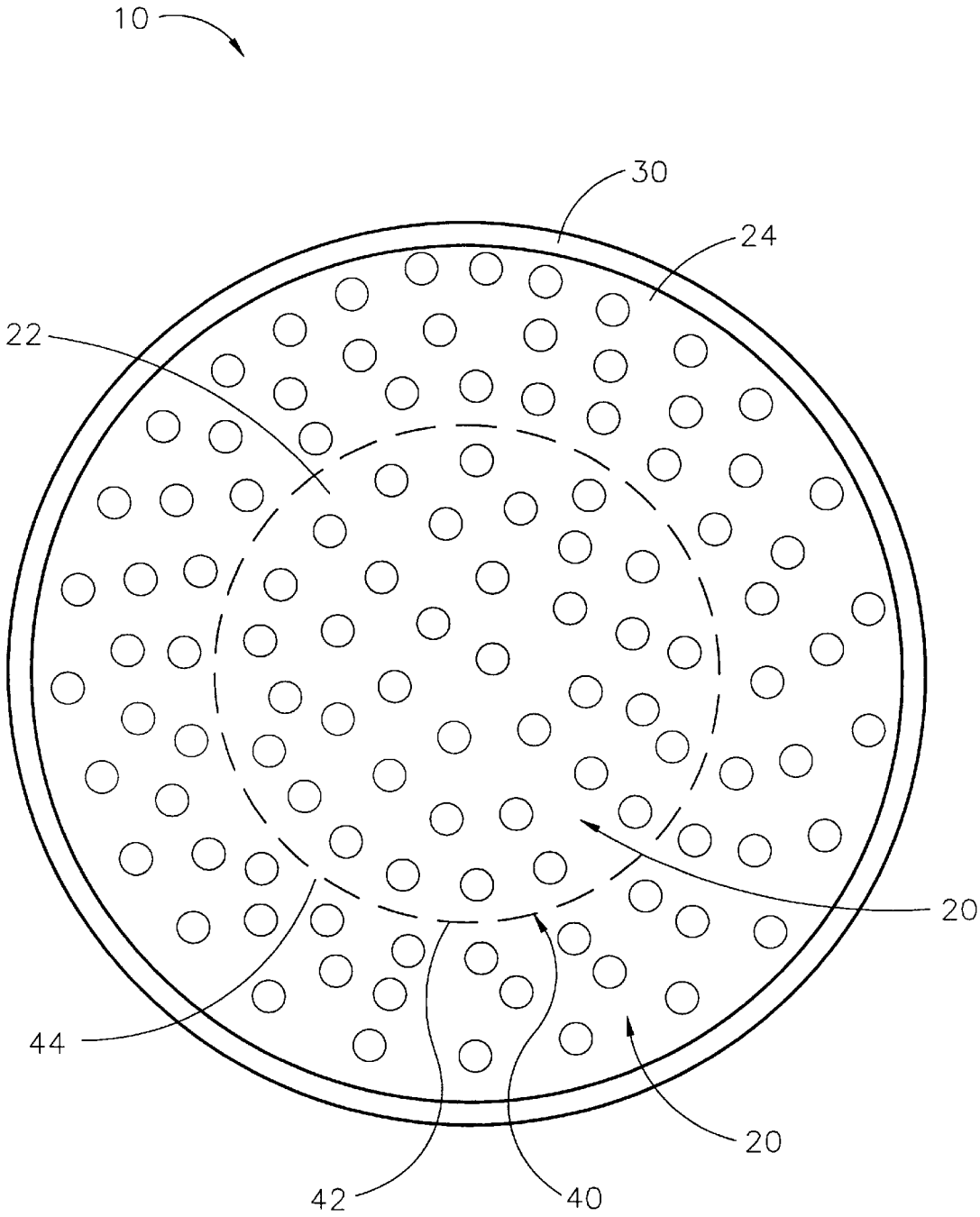
FIG. 3 is a cross-section view of a golf ball according to the invention.
Figure 4A:
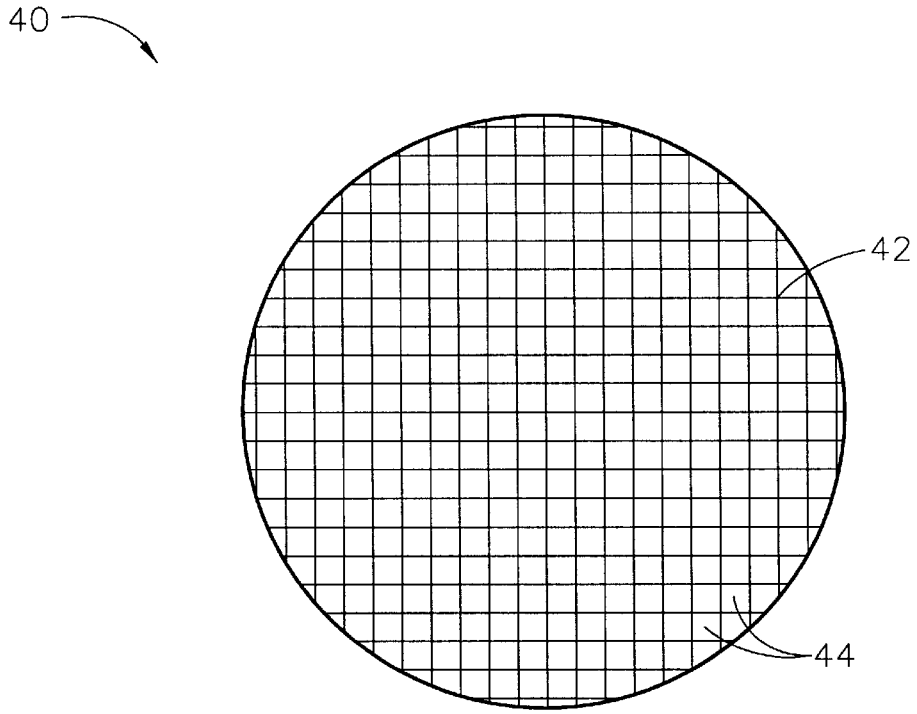
FIGS. 4*a* and 4*b* represent materials that could be used for the perforated barrier shell of the invention.
Figure 4B:
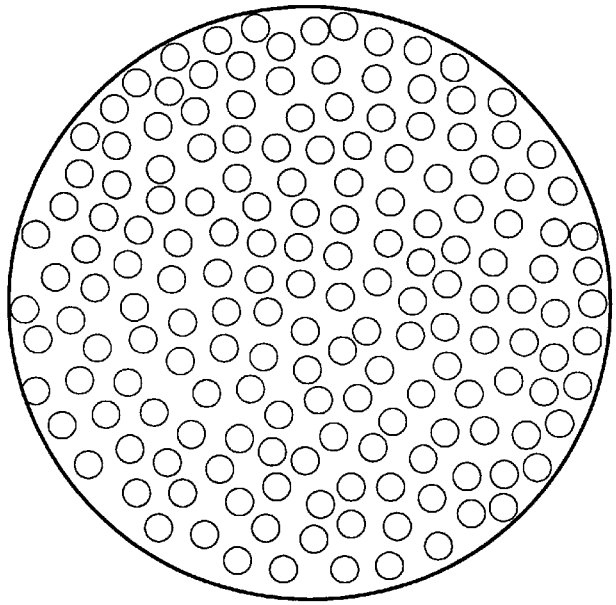

FIG. 3 shows a cross section of a golf ball 10 in accordance with the invention. Preferably, the ball comprises: (1) a core 20 including: (a) a compressible or resilient inner core 22, (b) a perforated barrier shell 40 positioned outside of and around inner core 22, and (c) an outer core 24 positioned outside of and around perforated barrier shell 40; and (2) an outer cover 30 positioned outside of and around outer core 24. Core 20 is preferably spherical and has a diameter of 1.45 to 1.61 inches.

Inner core 22 may be any compressible or resilient material, or combination of such materials. Suitable materials for inner core 22 are rubbers, plastics, or elastomers such as polybutadiene, or mixtures of such materials. Inner core 22 may or may not include fillers or reinforcement agents, which generally comprise particulate matter added to the core material to alter its properties or reduce costs. Further, inner core 22 may include, or be entirely comprised of, a liquid-filled bladder (these materials, structures and their methods of manufacture being known to those skilled in the art). The construction and material of inner core 22, however, are not critical. Any compressible or resilient core material may be used.

Outer cover 30 protects core 20 and can be comprised of any material, or layers of materials, durable enough to withstand the normal wear and tear to which golf ball 10 is subjected. Preferably, outer cover 30 is one or more layers of a blend of ionomeric resin materials such as those produced by DuPont and Exxon and known as SURLYN and IOTEK respectively, which are well known to those skilled in the art. Alternatively, urethane type materials, synthetic balata rubber type materials, or any polymer blend with the compressibility and durability features satisfactory for use on a golf ball may be used. Some resins suitable for use as outer cover 30 are disclosed in U.S. Pat. No. 4,836,552, the disclosure of which is incorporated by reference herein. Outer cover 30 may include a plurality of layers of one or more of the materials disclosed herein, or of any other material(s) capable of functioning as the outer cover of a golf ball. Outer cover 30 preferably has a thickness between 0.070 and 0.230 inches and may include dimples on the outer surface.

Perforated barrier shell 40 is shown in FIGS. 3–6. The material of which barrier shell 40 is formed can be either a mesh or screen material, as shown in FIG. 4*a*, or a preformed shell material as shown in FIG. 4*b*. Shell 40 is preferably formed of two hemispherical sections that, when brought together with core 22 in the center, preferably completely surround core 22. It is possible, however, that barrier shell 40 will not completely surround core 22 (for example, there may be a gap between the hemispherical sections). Shell 40 preferably has equally-spaced, symmetrical perforations 44 about its entire circumference and is preferably formed as a sphere 42 having the same center as ball 10 in order to provide equal rebound force across the impact area back against the face 11A of club 11 and to better balance the ball during flight. Barrier shell 40 is preferably non-compressible in order to reflect as much as the golf club's impact force as possible, although it may be compressible, as long as it reduces the amount of deformation of ball 10. Barrier shell 40 preferably has a common center with inner core 22 and outer core 24 and is thus located at the same place relative to outer cover 30 at all positions on ball 10. Therefore, when sphere 42 is used, regardless of how ball 10 lies or is positioned, perforated barrier shell 40 will always be a certain, predetermined distance inside of outer cover 30. It is contemplated that the best results will be obtained when a sphere, such as sphere 42, is used, and the sphere has a diameter approximately equal to one-half the diameter of ball 10. However, sphere 42 may have a larger or smaller diameter relative to the diameter of ball 10 and thereby be located at a different predetermined distance from outer cover 30 in order to alter the amount of ball 10 that is compressed between club face 11 A and the outer circumference of barrier shell 40 located closest to the point of impact of club 11. The ability to vary the diameter of barrier shell 40 will thus allow golf ball designers to change the rebound characteristics of golf ball 10 relative to the types of materials used for inner core 22, outer core 24, and cover 30 in order to adjust the compression rating, coefficient of restitution, and rebound velocity of ball 10. It will be noted, however, that barrier shell 40 is always spaced from outer cover 30. Barrier shell 40 and outer cover 30, therefore do not function together as a compound shell or compound outer cover.

Furthermore, by altering the size, quantity and/or spacing of perforations 44 the amount of force that is either reflected back against club face 11, or allowed to pass through barrier shell 40, can be changed thereby altering (1) the overall compression and coefficient of restitution of ball 10, and (2) the amount of energy and/or force transferred between outer core 24 and inner core 20 through the perforations. For example, given a barrier shell of a particular material and size, as the overall surface area of the perforations becomes smaller, the barrier shell becomes less permeable and less energy and/or force is transferred through the perforations. As the overall surface area of the perforations in the same barrier shell is made larger, the barrier shell becomes more permeable and more energy is transferred through the perforations.

Perforated barrier shell 40 can be manufactured from any material or combination of materials and can be of any shape (such as geodesic) and perforations 44 can be of any shape or size and have any equal or unequal spacing, as along as perforated barrier shell 40 reduces the overall deformation of ball 10 upon impact by ball 11. Preferably, barrier shell 40 is harder than inner core material 22 and outer core material 24 (hardness being measured in accordance with a testing method that determines Shore D hardness). Materials that may be used to produce the perforated barrier shell 40 are (1) metals such as steel, aluminum, titanium, copper, brass, zinc, or any alloys thereof, (2) many varieties of rigid plastics including, but not limited to, certain vinyls, polypropylenes, and polyethylenes, or (3) various composite type materials such as fiberglass, or any polymer or polymer blends reinforced with metal, glass, plastic, graphite, or carbon fibers.

Outer core 24 may comprise any compressible, resilient material or combination or layers of such materials. Suitable materials for outer core 24 are elastomers such as polybutadiene or mixtures of polybutadiene with other materials. Outer core 24 may or may not include fillers or reinforcement agents, which are generally particulate matter added to the core material to alter its properties or reduce costs. Further, outer core 24 may include, or be entirely comprised of, elastic windings or a polymer gel material; their respective compositions and method of manufacture being known to those skilled in the art. The construction and material of outer core 24, however, is not critical.

Additionally, virtually any combination of materials for inner core 22 and outer core 24 could be used to form core 20 as long as inner core 22 and outer core 24 can communicate with each other through at least some of the perforations 44 in perforated barrier shell 40 and allow energy to transfer from one to the other when ball 10 is struck by club 11. Preferably, the material forming inner core 22 is physically connected to the material forming outer core 24 through perforations in barrier shell 40. It is possible, however, that because of different manufacturing methods and the materials selected for inner core 22 and outer core 24, respectively, that there is no physical connection. However, as long as physical contract occurs through perforations 44 permitting the transfer of energy and/or force from outer core 24 into and through inner core 22 when ball 10 is struck with normal force by club 11, there is still a continuous physical medium for the transfer of force.

Figure 5:
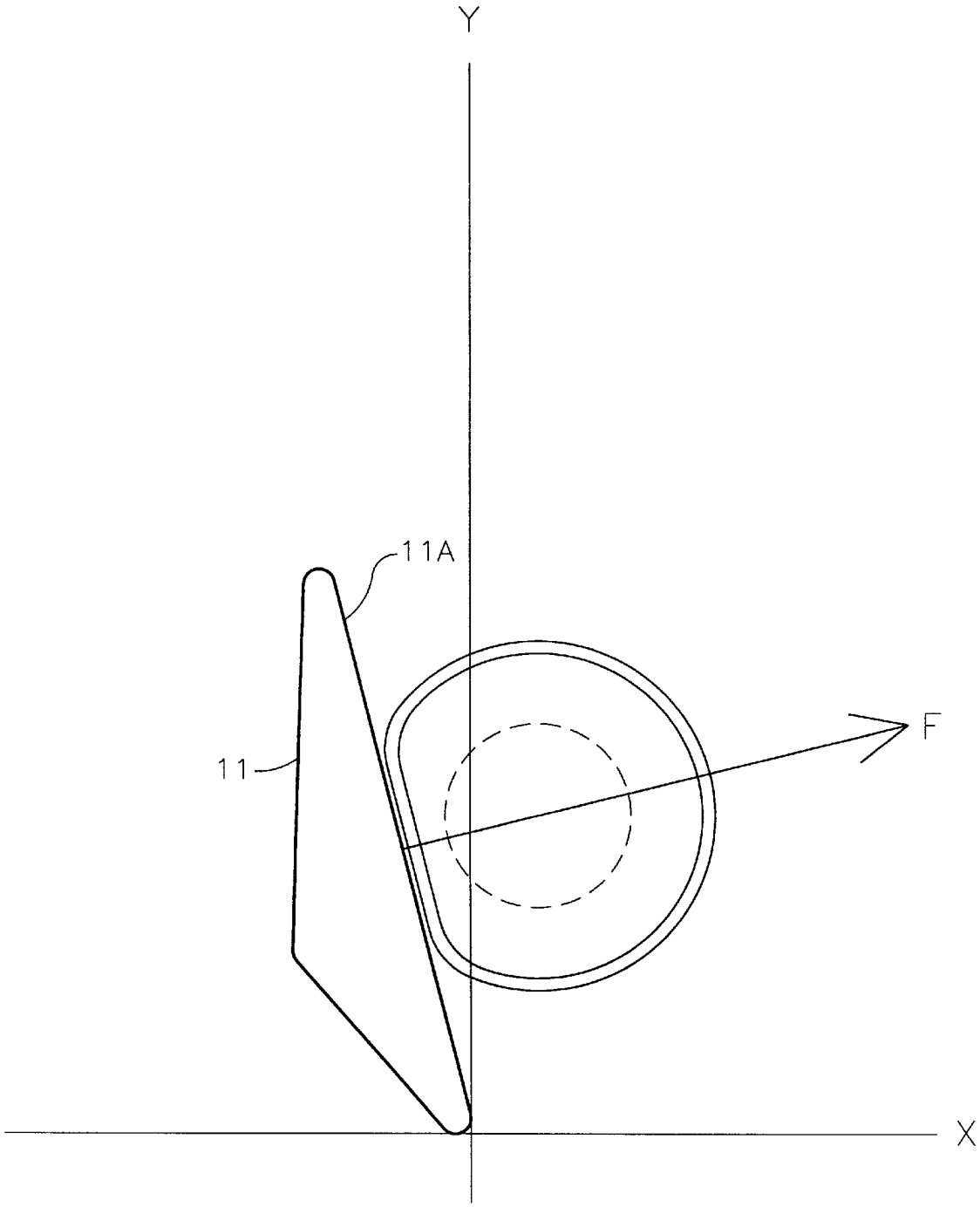
FIG. 5 is a cross-sectional view of the golf bail shown in FIG. 4 being struck by a golf club.
Figure 5A:
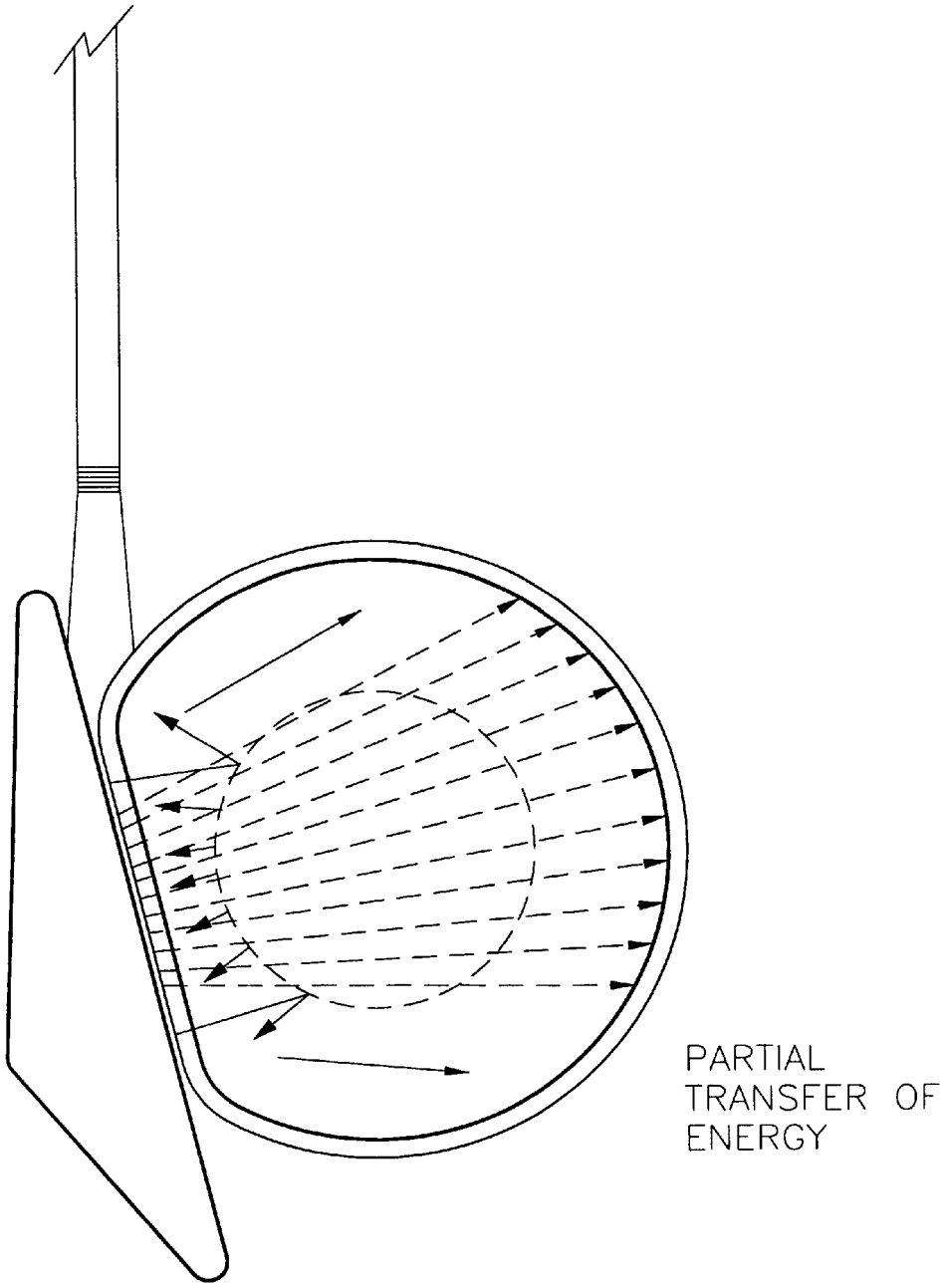
FIG. 5*a* is a cross-sectional view of the golf ball shown in FIG. 4 being struck by a golf club, which shows the redirected force believed to be responsible for the improved performance of the ball.

FIGS. 5 and 5*a* depict a golf ball 10 wherein perforated barrier shell 40 has limited the deformation of ball 10 upon impact with club 11. Because ball 10 is not deformed to the same degree as previously described ball 1, it is believed that more rebound force is confined to the immediate area between club face 11A at its point of contact with ball 10 and the surface of perforated barrier shell 40 located closest to the point of impact. Since this rebound force has been redirected by perforated barrier shell 40 and not otherwise expended in the non-productive deformation of areas of ball 10 located farthest away from the point of impact with club 11, more rebound force is thus transmitted along vector F hence increasing the initial velocity and length of travel of ball 10. It should be noted that the present invention should improve the travel of a golf ball having any compression (compression generally being referred to by a number such as "90,""100," or "110," for example, with higher numbers denoting higher compression, as measured using golf ball compression tests known to those skilled in the art).

Figure 6:
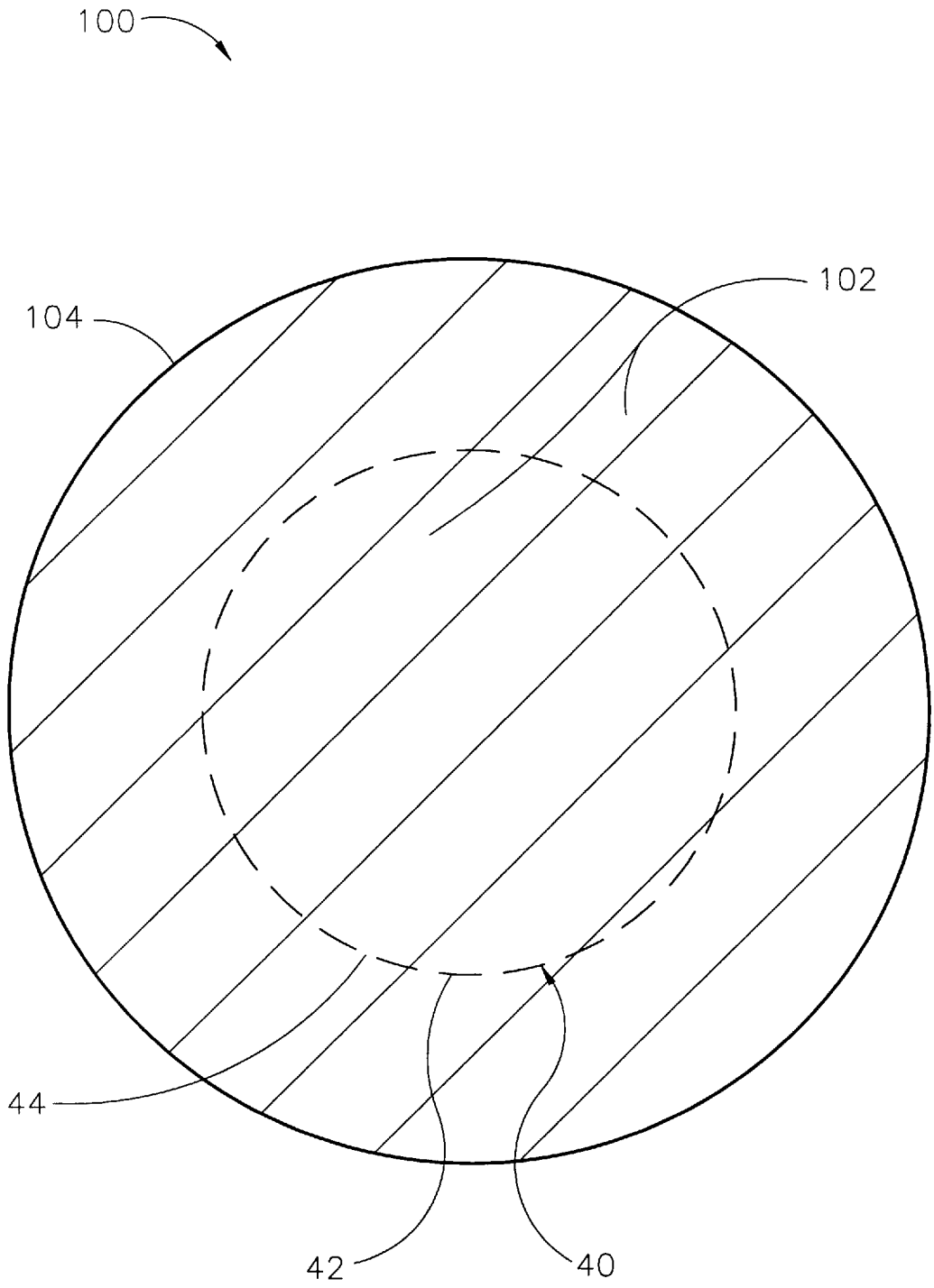
FIG. 6 is a cross-sectional view of a one-piece golf ball according to the invention.
Figure 7:
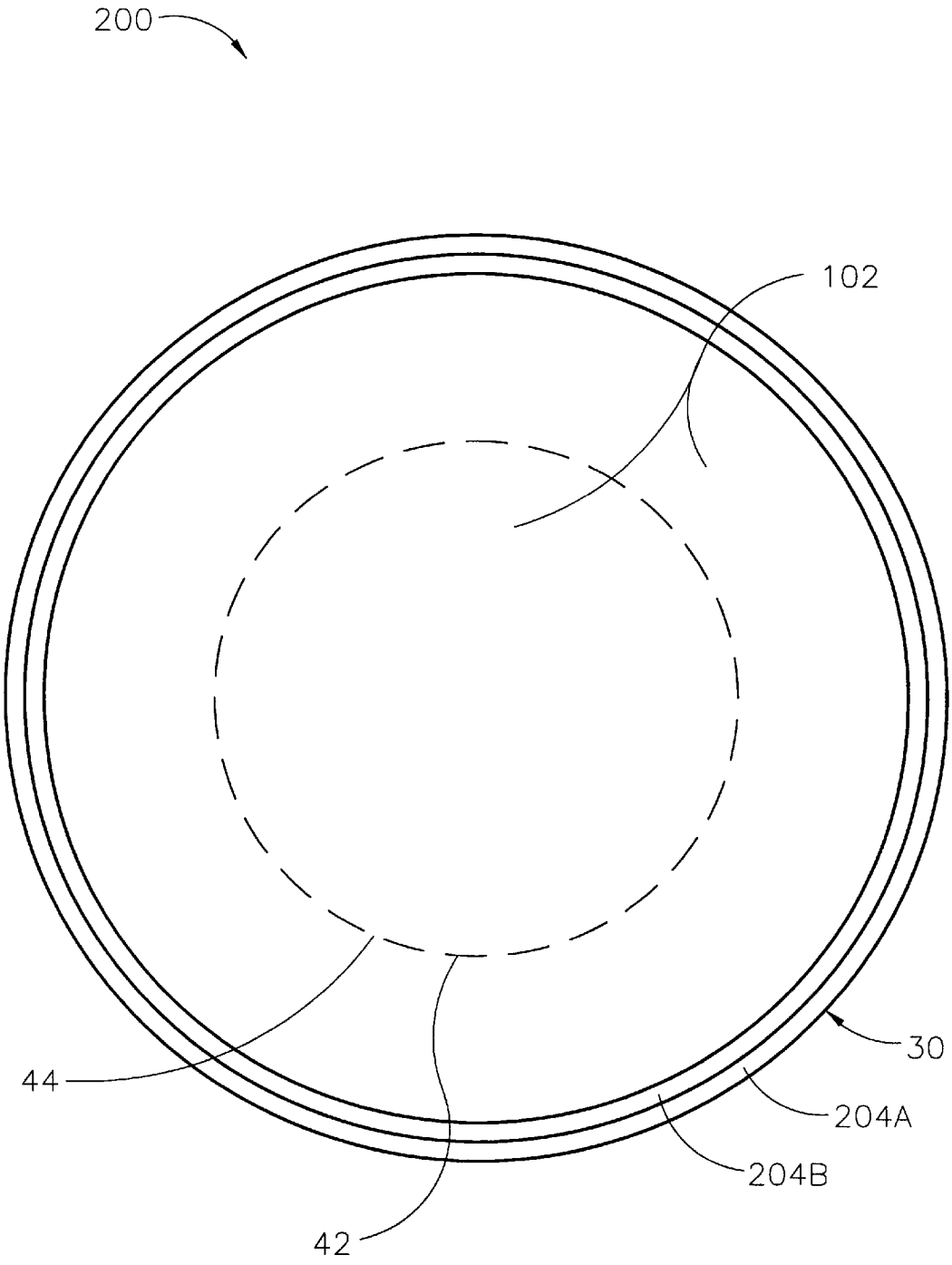
FIG. 7 is a cross-sectional view of a golf ball according to the invention having an outer cover comprising more than one layer.
Figure 8A:
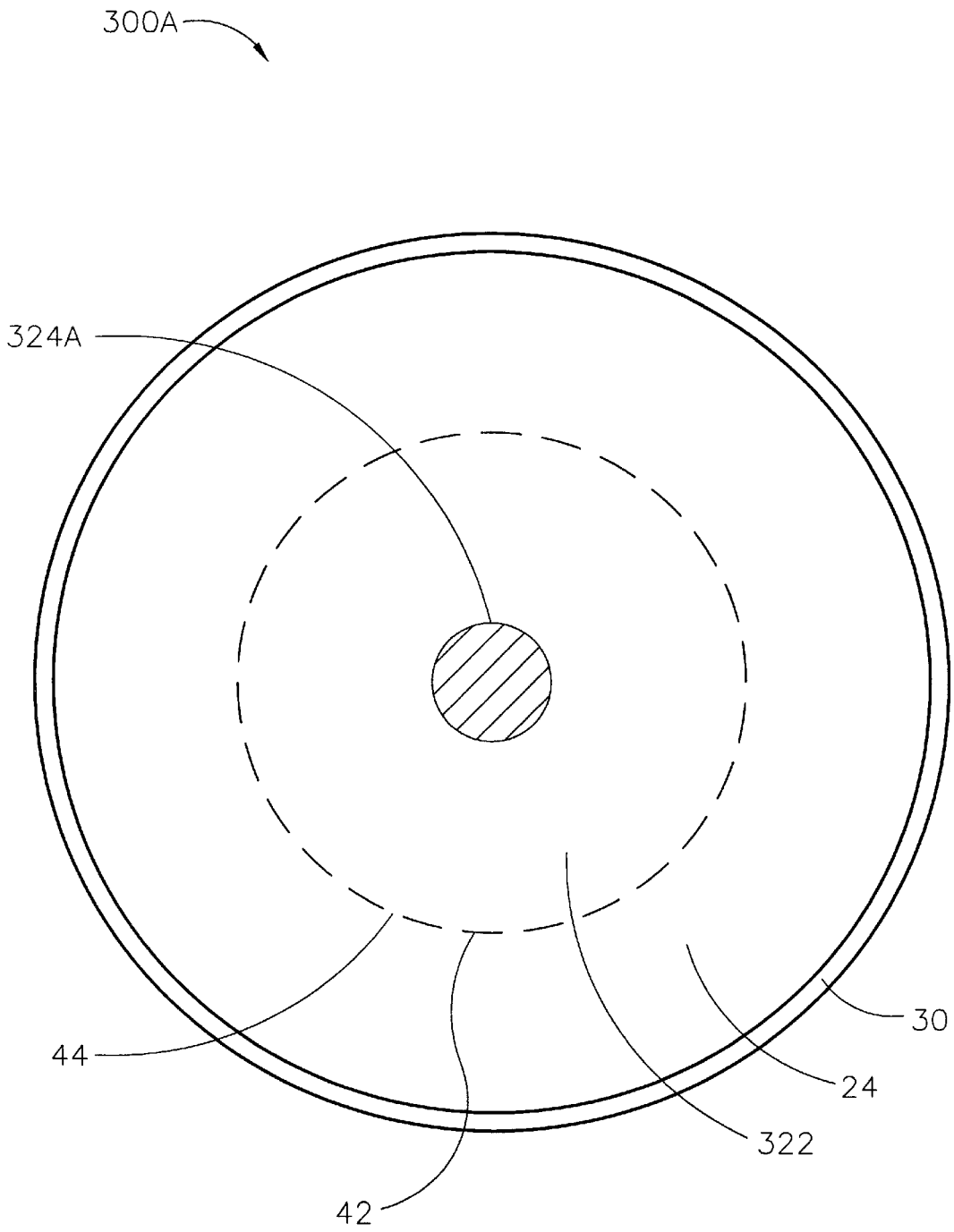
FIG. 8*a* is a cross-sectional view of a golf ball according to the invention wherein the inner core includes a liquid center.
Figure 8B:
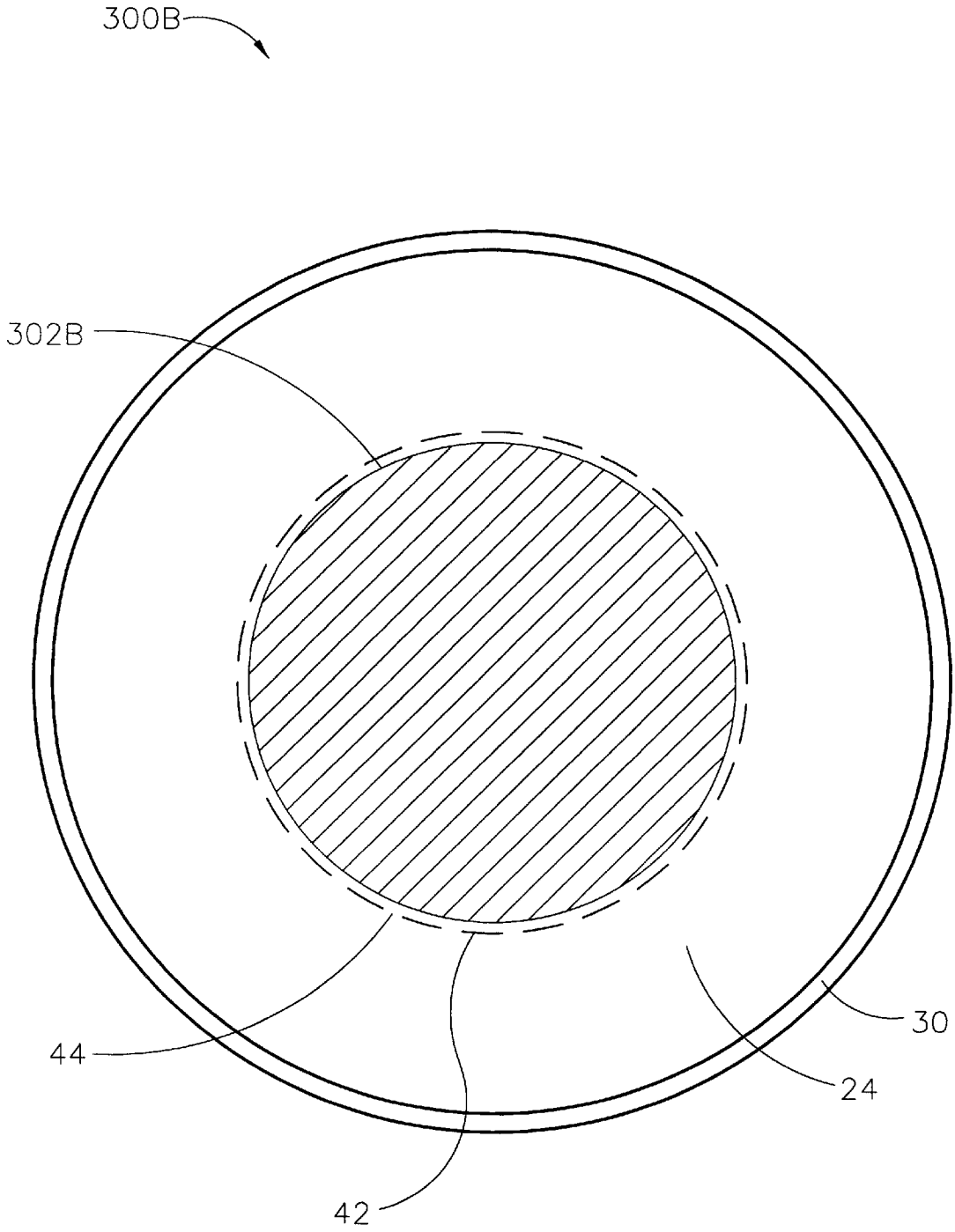
FIG. 8*b* is a cross-sectional view of a golf ball according to the invention wherein the inner core is a liquid center.
Figure 9:
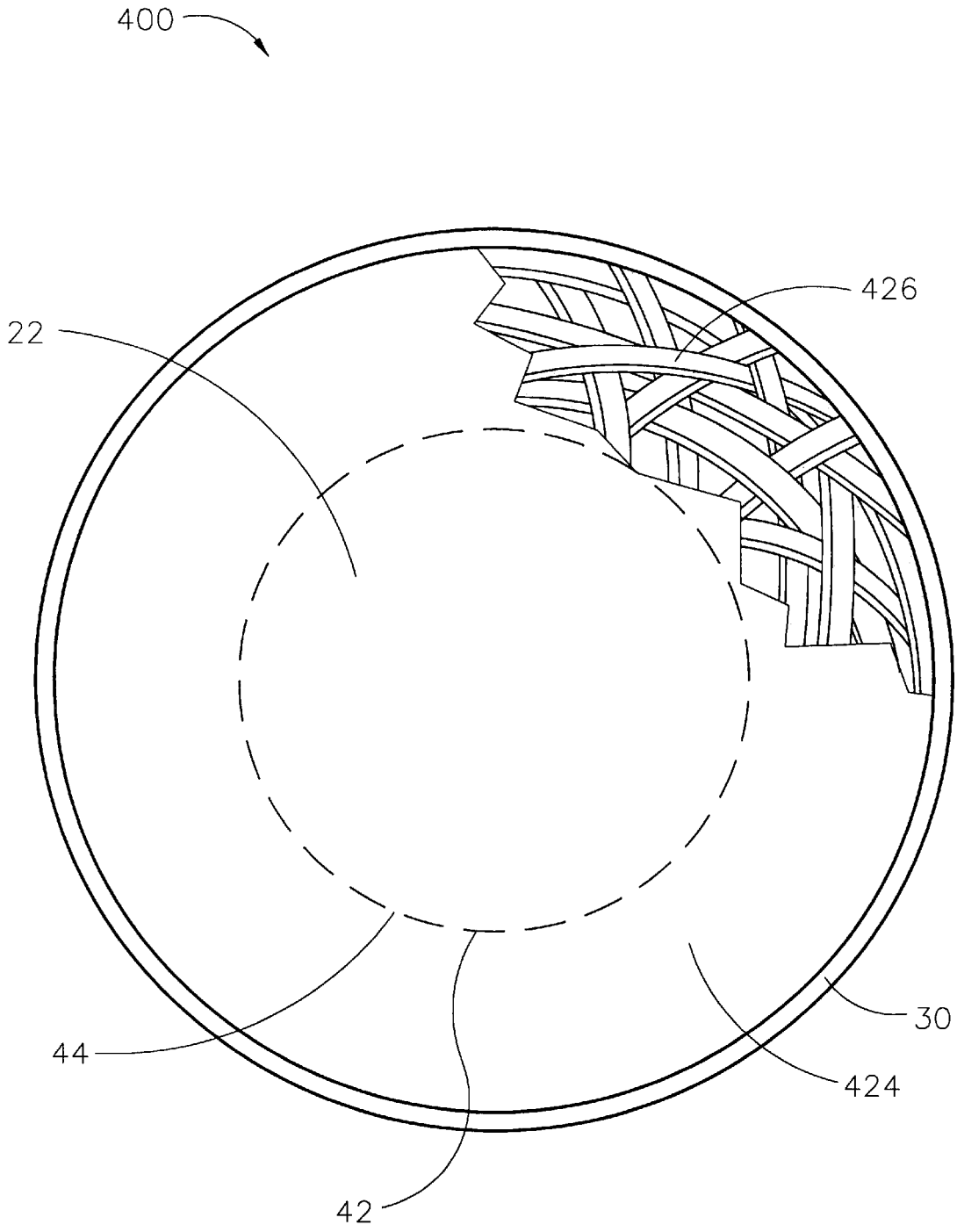
FIG. 9 is a cross-sectional view of a golf ball according to the invention showing a partial, sectional view of an outer core comprising windings.

FIG. 6 shows a one-piece ball 100 according to the invention. Ball 100 is molded as a one-piece sphere (in a manner known to those skilled in the art) such that its core area 102 and dimpled surface area 104 are of the same compressible and resilient polymer material with perforated barrier shell 40 molded within and thus included as an integral part of ball 100. Barrier shell 40 is constructed and functions in the same manner as previously described.

It is contemplated that golf ball 10 could be manufactured in a variety of ways. First, perforated barrier shell 40 may be provided as a sphere 42 comprised of two hemispherical sections that can be interlocked or otherwise connected. Inner core 22, depending upon its composition, is manufactured in an appropriate method by those skilled in the art such as compression molding, injection molding, rotational injection molding, or injecting and sealing liquid into a malleable spherical bladder. Alternatively, if inner core 22 is polybutadiene rubber, the uncured rubber may be used. The uncured rubber is placed inside the first of the hemispherical sections of perforated barrier shell 40, and the second hemispherical section is positioned over the opposite side of inner core 22 and connected to the first hemispherical section. Thus, inner core 22 is positioned inside of perforated barrier shell 40 and a subcomponent of ball 10 is formed. This subcomponent is then used in a molding process whereby outer core 24 is formed around perforated barrier shell 40 and the uncured rubber is simultaneously cured to form inner core 22. Alternatively, elastic thread can be wound about perforated barrier shell 40 to form outer core 24. Last, the finished core 20, comprised of inner core 22, perforated barrier shell 40, and outer core 24 (regardless of their respective compositions) then has cover material 30 formed about its surface.

It is also contemplated that an injection molding or rotational injection molding process (hereinafter referred to collectively as injection molding), or any process that begins with a liquid or semi-liquid core material could be used to form ball 10 or ball 100. In that case, perforated barrier shell 40 may be embedded in core 20 or core 102 during manufacture. In an injection molding process there is a mold (not shown) including a cavity. Typically the mold is closed and held closed under force while a liquid or semi-liquid core material is injected into the mold. The liquid cures and forms a finished sphere. Utilizing such an injection molding process, perforated barrier shell 40 could be embedded in core 20 or core 102 simply by placing it in the cavity of the mold prior to injecting the liquid or semi-liquid material. Locator pins or other mechanical devices may be used to position perforated barrier shell 40 within the center of the cavity. Liquid or semi-liquid core material is then injected under pressure into the cavity passing through perforations 44 in perforated barrier shell 40 filling inner core area 22 and outer core area 24 of ball 10 or inner core areas 102 of ball 100. The result would be relatively uniform dispersion of the injected material giving inner core 22, outer core 24, or core 102 a relatively uniform density having perforated barrier shell 40 embedded therein.

Having now defined a preferred embodiment, variations that do not depart from the spirit of the invention will become apparent to those skilled in the art. The invention is thus not limited to the preferred embodiment, but is instead set forth in the following claims and legal equivalents thereof.

What is claimed is:

1. A golf ball comprising:

(a) a core including:

(i) a resilient inner core;

(ii) a perforated barrier shell positioned outside of the inner core;

(iii) a compressible outer core positioned outside of the perforated barrier shell; and (b) an outer cover surrounding the outer core, wherein said outer core and said outer cover together occupy at least 40% of the volume of said ball.

2. The golf ball of claim 1 wherein the perforated barrier shell is shaped as a sphere.

3. The golf ball of claim 1 wherein the outer cover is comprised of balata.

4. The golf ball of claim 1 wherein the outer cover is comprised of an ionomeric resin.

5. The golf ball of claim 1 wherein the outer cover is comprised of urethane.

6. The golf ball of claim 1 wherein the outer cover is comprised of more than one layer.

7. The golf ball of claim 1 wherein the inner core is polybutadiene.

8. The golf ball of claim 1 wherein the inner core includes a liquid center.

9. The golf ball of claim 1 wherein the inner core is a liquid center.

10. The golf ball of claim 1 wherein the outer core includes windings.

11. The golf ball of claim 1 wherein the outer core includes elastic windings.

12. The golf ball of claim 1 wherein the outer core is polybutadiene.

13. The golf ball of claim 1 wherein the outer core is comprised of layers of polybutadiene.

14. The golf ball of claim 1 wherein the outer core is a polymer gel material.

15. The golf ball of claim 1 wherein the perforated barrier shell is comprised of metal.

16. The golf ball of claim 1 wherein the perforated barrier shell comprised of plastic.

17. The golf ball of claim 1 wherein the perforated barrier is comprised of a composite material.

18. The golf ball of claim 1 that further includes dimples on the outer surface of the outer cover.

19. The golf ball of claim 1 wherein the outer core is physically separated from the inner core when the ball is not compressed.

20. The golf ball of claim 1 wherein the inner core is not comprised of the same material as the outer core.

21. A two-piece golf ball comprising:

(a) a compressible core having an outer surface; and (b) a perforated barrier shell embedded in the core, the perforated barrier shell so positioned within the core that at least 40% of the volume of the golf ball lies outside the perforated barrier shell.

22. The golf ball of claim 21 wherein the perforated barrier shell is shaped as a sphere.

23. The golf ball of claim 21 wherein the perforated barrier shell is harder than the core.

24. The golf ball of claim 23 wherein the perforated barrier shell is metal.

25. The golf ball of claim 23 wherein the perforated barrier shell is a composite material.

26. The golf ball of claim 21 wherein the perforated barrier shell is plastic.

27. The golf ball of claim 21 wherein the perforated barrier shell is molded in place as an integral part of the ball.

28. A golf ball comprising:

(c) a core including:

(i) a resilient inner core, (ii) a perforated barrier shell shaped as a sphere and positioned outside of the inner core, (iii) a compressible outer core positioned outside of the perforated barrier shell, and (d) an outer cover surrounding the outer core, wherein the perforated barrier shell has a diameter and the golf ball has a diameter, the diameter of the perforated barrier shell being not more than approximately one-half the diameter of the golf ball.

29. The golf ball of claim 28 wherein the inner core includes a liquid center.

30. The golf ball of claim 28 wherein the inner core is a liquid center.

31. The golf ball of claim 28 wherein the outer core includes windings.

32. The golf ball of claim 28 wherein the outer core includes elastic windings.

33. The golf ball of claim 28 wherein the outer core is comprised of layers of polybutadiene.

34. The golf ball of claim 28 wherein the outer core is a polymer gel material.

35. The golf ball of claim 28 wherein the diameter of the perforated barrier shell is approximately one-half the diameter of the golf ball.

* * * * *